US007582129B2

(12) United States Patent
Kim et al.

(10) Patent No.: US 7,582,129 B2
(45) Date of Patent: Sep. 1, 2009

(54) MULTI-CYCLONE DUST SEPARATING APPARATUS

(75) Inventors: Min-ha Kim, Gwangju (KR); Jung-gyun Han, Gwangju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 565 days.

(21) Appl. No.: 11/406,726

(22) Filed: Apr. 19, 2006

(65) Prior Publication Data

US 2007/0079581 A1 Apr. 12, 2007

(30) Foreign Application Priority Data

Oct. 10, 2005 (KR) ..... 10-2005-0095103

(51) Int. Cl.
*B01D 45/12* (2006.01)

(52) U.S. Cl. ..... 55/345; 55/346; 55/349; 55/DIG. 3; 15/353

(58) Field of Classification Search ..... 55/345, 55/459.1, 337, 343, 348, 346, 349, DIG. 3; 15/353

See application file for complete search history.

(56) References Cited

U.S. PATENT DOCUMENTS

| | | | | |
|---|---|---|---|---|
| 6,428,589 | B1 | 8/2002 | Bair et al. | 55/318 |
| 6,797,026 | B2 * | 9/2004 | Sechrist et al. | 55/348 |
| 7,175,682 | B2 * | 2/2007 | Nakai et al. | 55/429 |
| 2004/0079057 | A1 * | 4/2004 | Sechrist et al. | 55/348 |
| 2005/0050678 | A1 * | 3/2005 | Oh et al. | 15/353 |
| 2005/0138761 | A1 * | 6/2005 | Park et al. | 15/352 |
| 2005/0160554 | A1 | 7/2005 | Ueyama et al. | 15/353 |
| 2006/0130265 | A1 * | 6/2006 | Oh et al. | 15/327.2 |

(Continued)

FOREIGN PATENT DOCUMENTS

DE 102004028675 4/2005

(Continued)

OTHER PUBLICATIONS

Search Report dated Mar. 27, 2008 corresponding to European Patent Application No. 06290938.7.

(Continued)

*Primary Examiner*—Duane Smith
*Assistant Examiner*—Dung Bui
(74) *Attorney, Agent, or Firm*—Ohlandt, Greeley, Ruggiero & Perle, L.L.P.

(57) ABSTRACT

Disclosed is a multi-cyclone dust separating apparatus, comprising a cyclone body, a top cover and a discharge cover. The cyclone body includes a main cyclone and a plurality of cyclone cones communicating with the main cyclone and arranged around a lower part of the main cyclone, each of which has a reverse conical shape whose diameter is reduced as approaching the top end thereof. The top cover is fitted on the top of the cyclone body and has an air inflow port introducing ambient air into the main cyclone. The discharge cover is fitted on the bottom of the main cyclone and collects and discharges the air discharged from the plurality of cyclone cones. Most of the air introduced into the top of the main cyclone through the air inflow port is discharged to the bottom of the main cyclone without being reversed to flow upwardly and then introduced into the plurality of cyclone cones.

8 Claims, 6 Drawing Sheets

U.S. PATENT DOCUMENTS

| | | | | |
|---|---|---|---|---|
| 2006/0230716 | A1* | 10/2006 | Oh et al. | 55/343 |
| 2007/0089381 | A1* | 4/2007 | Ni | 55/345 |

FOREIGN PATENT DOCUMENTS

| | | |
|---|---|---|
| EP | 0885585 | 4/2002 |
| FR | 2865917 | 8/2005 |
| GB | 2360719 | 10/2001 |
| GB | 2372468 | 8/2002 |
| KR | 1020030062520 | 7/2003 |
| RU | 2035239 | 5/1995 |
| WO | WO 00/74548 | 12/2000 |
| WO | WO02/067755 | 9/2002 |
| WO | WO02/067756 | 9/2002 |

OTHER PUBLICATIONS

Office Action dated Aug. 28, 2007 corresponding to Russian Patent Application No. 2006118000.

* cited by examiner

MULTI-CYCLONE DUST SEPARATING APPARATUS

CROSS-REFERENCE TO RELATED APPLICATIONS

This application claims benefit under 35 U.S.C. § 119(a) of Korean Patent Application No. 2005-95103, filed Oct. 10, 2005 in the Korean Intellectual Property Office, the entire contents of which are incorporated herein by reference.

BACKGROUND OF THE INVENTION

1. Field of the Invention

The present invention relates to a vacuum cleaner, and in particular to a multi-cyclone dust separating apparatus, which is employed in a vacuum cleaner so as to filter dust suctioned from a surface to be cleaned together with air, using centrifugal force over two or more steps.

2. Description of the Related Art

In general, a vacuum cleaner comprises a bottom brush for suctioning dust from a surface to be cleaned together with air, a motor driving chamber provided with a driving source, and a vacuum cleaner body provided with a cyclone collection apparatus.

The cyclone collection apparatus is constructed in such a way that dust containing air, which is introduced from the bottom brush, is caused to form a swirling stream, so that dust is separately collected from the air by centrifugal force, and clean air is discharged into the motor driving chamber. In recent years, in order to improve dust collection efficiency, there has been proposed a multi-cyclone dust separating apparatus that separates dusts contained in air over two or more steps or more, wherein such a multi-cyclone dust separating apparatus comprises one or more secondary cyclones.

The above-mentioned types of conventional multi-cyclone dust separating apparatus are disclosed in WO02/067755 and WO02/067756 (Dyson Ltd). However, such conventional multi-clone dust separating apparatus have a disadvantage in that that because an upstream cyclone (a first cyclone), and a downstream cleaner (a second cyclone) are vertically arranged, thereby increasing the entire height of the dust-collection apparatus, they are mainly applied to an upright-type cleaner but hard to be applied to a canister-type cleaner. In addition, since the entire air flow path is long in the cyclone dust separating apparatus, there is a problem in that a loss in suction force of a driving source is high.

In order to solve the above-mentioned problems, the applicant developed a multi-cyclone dust separating apparatus (Korean Patent Application No. 2003-62520) as shown in FIG. 1. As shown the drawing, a multi-cyclone dust separating apparatus 10 comprises a cyclone body 20 with a first cyclone 30 and a second cyclones 40 being arranged around the periphery of a first cyclone 30, a cover unit 60 fitted on the top of the cyclone body 20, and a dust collection bin 70 connected to the bottom of the cyclone body 20. The cyclone body 20 is provided with an air inflow port 21, so that ambient air introduced into the first cyclone 30 passes through the cyclone body 20, and the cyclone cover 60 is provided with an air outflow port 62 through which purified air is discharged. Such a multi-cyclone dust separating apparatus 10 has an effect of increasing the dust collection efficiency because the plurality of second cyclones 40 are arranged around the first cyclone 30.

However, as shown in FIG. 1, the multi-cyclone dust separating apparatus 10 is configured in such a way that the ambient air is introduced into the top of the first cyclone 30 and then discharged to the top. In other words, the introduced air first flows downwardly (arrow B), then reverses direction and flows upwardly (arrow C), then escapes the upper portion of the first cyclone 30 via a grill member 80, and then flows into the second cyclones 40. Like this, there is a problem in that the air flow path from the introduction of air into the multi-cyclone dust separating apparatus 10 to the discharge of air out of the multi-cyclone dust separating apparatus 10 is still too long.

In addition, although the above-mentioned multi-cyclone dust separating apparatus 10 can be reduced in overall height as compared to the prior art, efforts for reducing heights of dust separating apparatus have been continued so as to miniaturize cleaners.

SUMMARY OF THE INVENTION

Accordingly, the present invention has been made to solve the above-mentioned problems occurring in the prior art, and an object of the present invention is to provide a multi-cyclone dust separating apparatus improved in such a manner as to reduce an air flow path in the dust separating apparatus so as to decrease a loss in suction force.

Another object of the invention is to provide a multi-cyclone dust separating apparatus, which is reduced in overall height, so that it can be easily applied to a small-sized cleaner.

In order to achieve the above-mentioned objects, there is provided a multi-cyclone dust separating apparatus comprising: a cyclone body including a main cyclone, and a plurality of cyclone cones communicating with the main cyclone and arranged around a lower part of the main cyclone, each cyclone cone being formed in a reverse conical shape whose diameter is reduced as approaching the top end thereof; a top cover fitted on the top of the cyclone body and having an air inflow port for introducing ambient air into the main cyclone; and a discharge cover fitted on the bottom of the main cyclone so as to collect and discharge the air discharged from the plurality of cyclone cones, wherein most of the air introduced into the top of the main cyclone through the air inflow port is discharged to the bottom of the main cyclone without reversing direction to ascend, thereby being introduced into the plurality cyclone cones.

It is preferable that the plurality of cyclone cones are arranged to be symmetrical about an inner wall of the main cyclone.

It is also preferable that the central axis of a swirling stream produced in the main cyclone and a central axis of a swirling stream produced in each of the plurality of cyclone cones are not parallel to each other.

Each of the plurality of cyclone cones may be configured in such a way that the central axis of the swirling stream produced in each of the cyclone cone is more spaced from the central axis of the swirling stream produced in the main cyclone as approaching the top end thereof.

The top cover may be detachably fitted to the cyclone body.

The dust is collected in the cyclone body after being separated from the air in the main cyclone and the plurality of cyclone cones.

According to another aspect of the present invention, there is provided a multi-cyclone dust separating apparatus comprising: a cyclone body including a main cyclone, and a plurality of cyclone cones arranged around a lower part of the main cyclone, each cyclone cone having a reverse conical shape whose diameter is reduced as approaching the top end thereof; and a top cover fitted on the top of the cyclone body and having an air inflow port of a spiral structure, wherein the air introduced through the air inflow port separates from dust by swirling in the main cyclone and is introduced into the plurality of cyclone cones to secondarily filter fine dust contained in the air.

BRIEF DESCRIPTION OF THE DRAWINGS

The above aspects and features of the present invention will be more apparent from the description for certain embodiments of the present invention taken with reference to the accompanying drawings, in which.

DETAILED DESCRIPTION OF THE PREFERABLE EMBODIMENTS

Hereinbelow, the preferable embodiments of the present invention are described in detail with reference to accompanying drawings.

Figure 2:
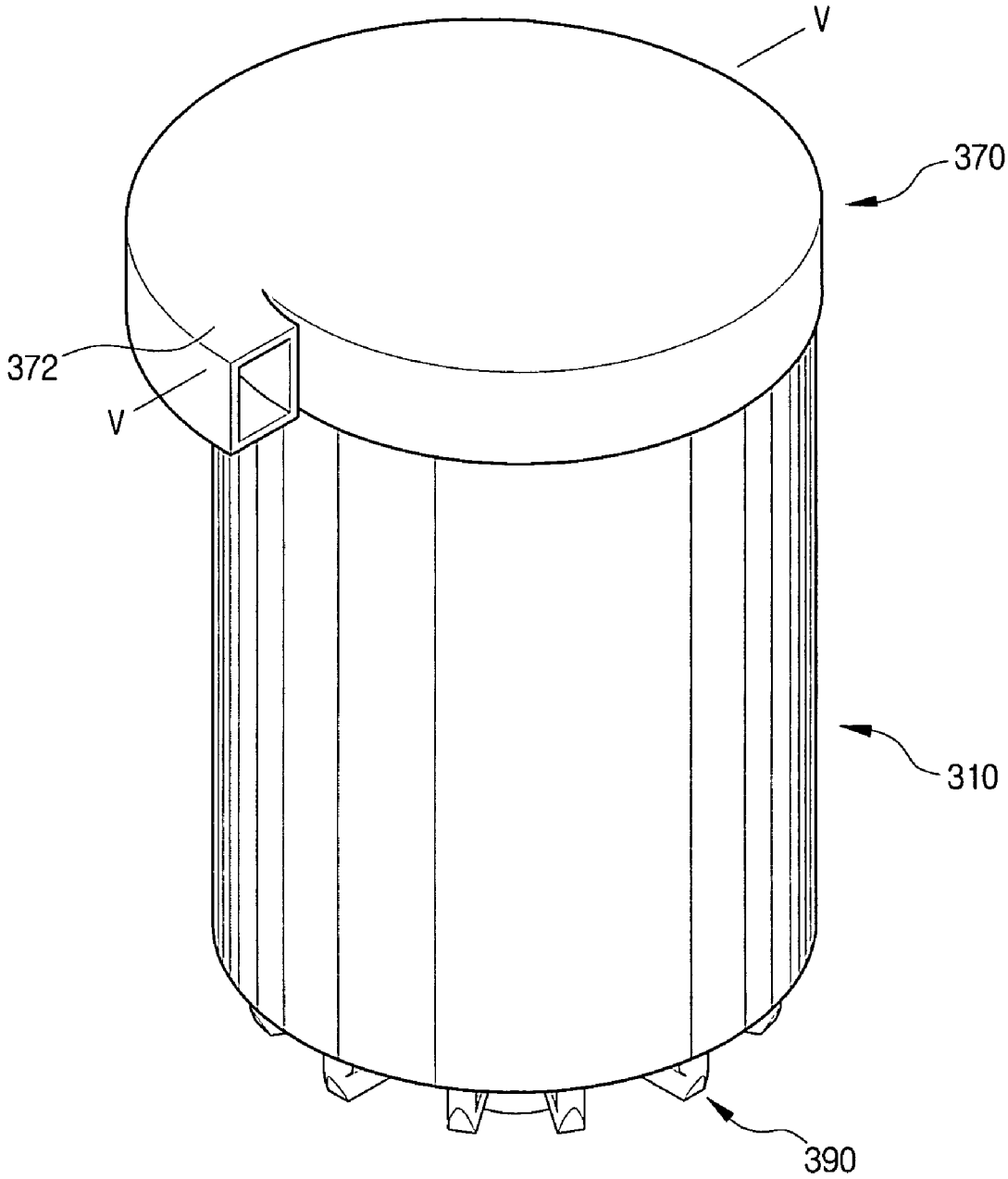
FIG. 2 is an external perspective view of a multi-cyclone dust separating apparatus according to an embodiment of the present invention.
Figure 3:
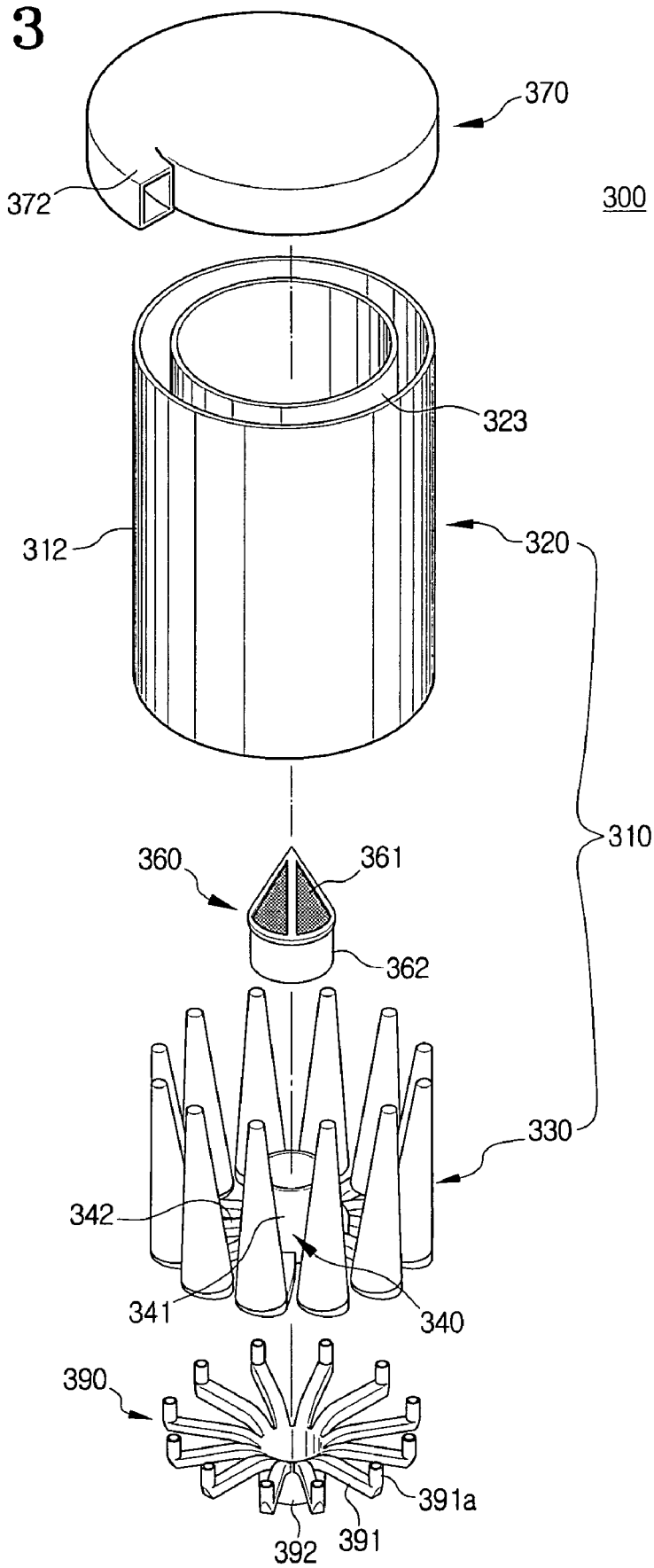
FIG. 3 is an exploded perspective view of the multi-cyclone dust separating apparatus shown in FIG. 2.
Figure 4:
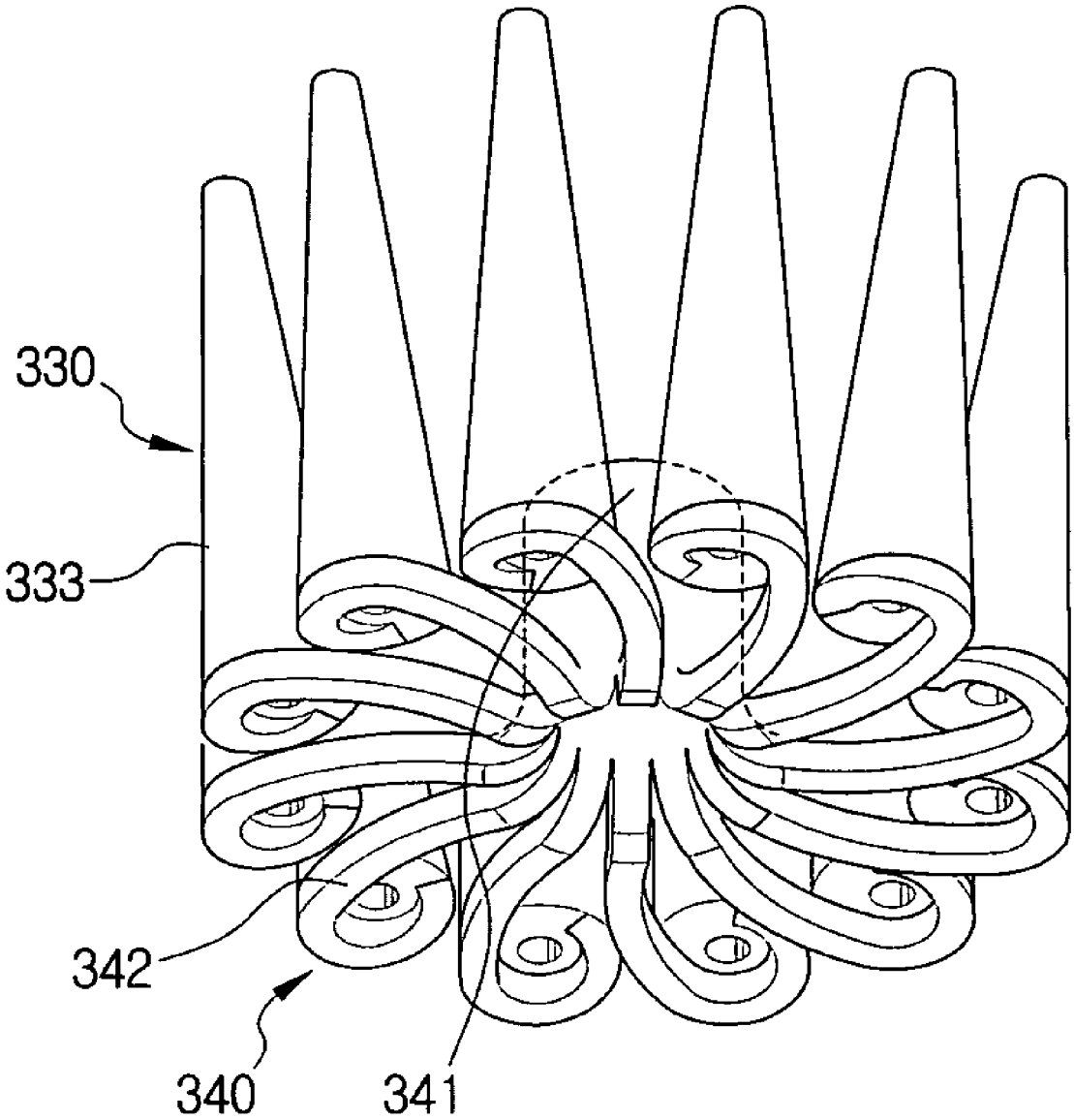
FIG. 4 is a bottom side perspective view of cyclone cones shown in FIG. 3.

Referring to FIGS. 2 to 4, a multi-cyclone dust separating apparatus 300 comprises a cyclone body 310, a top cover 370, and a discharge cover 390.

The cyclone body 310 causes dust containing air introduced from the exterior to swirl, so that the dust is filtered from the air over two steps. The cyclone body 310 comprises a main cyclone 320 and a plurality of cyclone cones 330.

Figure 5:
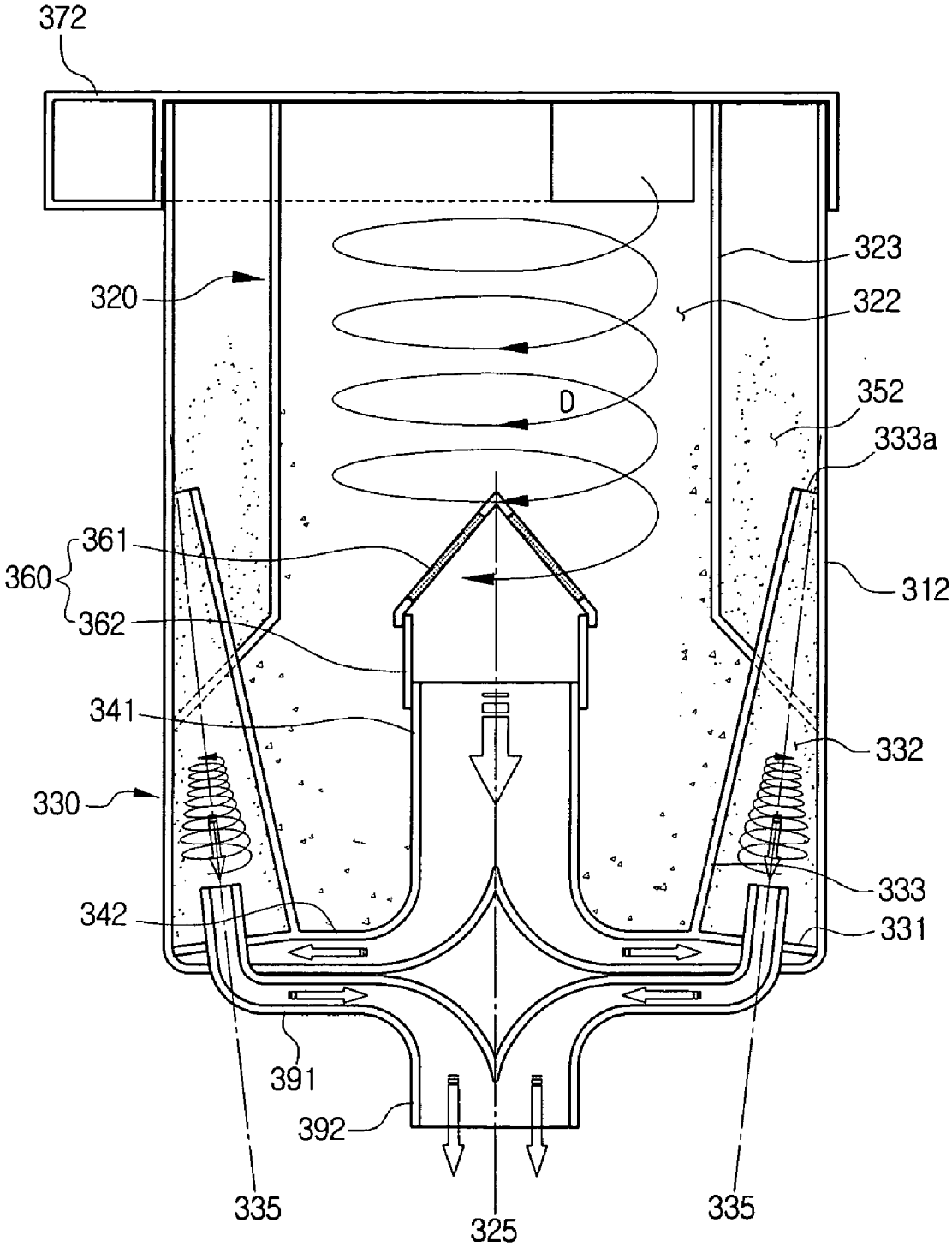
FIG. 5 is a sectional view taken along line V-V of FIG. 2.

The main cyclone 320 has an outer wall 312 and an inner wall 323 forming a cyclone chamber 322 (see FIG. 5). Dust containing air is introduced into the cyclone chamber 322 through an air inflow port 372 formed through the top cover 370 and swirls within the cyclone chamber 322, so that the dust is separated from the air. The dust separated from the air is collected on a bottom part of the cyclone chamber 322.

The cyclone chamber 322 is provided with a grill member 360 at the central part thereof. The grill member 360 comprises a body part 362 with a bottom connected to a top of an inflow path 341, and a mesh-type filter part 361 connected to the top of the body part 362 so as to filter dust from air. The air separated from the dust in the cyclone chamber 322 flows to the bottom of the cyclone chamber 322 through the grill member 360.

The fine dust filtered by the plurality of cyclone cones 330 is collected in a space 352 between the inner wall 323 and the outer wall 312 (see FIG. 5).

The plurality of cyclone cones 330 secondarily filter the fine dust contained in the air introduced into the plurality of cyclone cones 330 by way of the main cyclone 320. The plurality of cyclone cones 330 are spaced from each other and arranged approximately parallel to each other around the lower part of the main cyclone 320 in such a manner as to be symmetrical to each other about the main cyclone 320. It is preferable that the plurality of cyclone cones 330 have the same size and shape as each other. In addition, the plurality of cyclone cones 330 are symmetrically arranged with respect of the center of the main cyclone 320.

Meanwhile, according to the invention, since the main cyclone 320 has a downwardly discharging structure, the plurality of cyclone cones 330 are also arranged for air to be introduced into the plurality of cyclone cones 330 through the bottoms thereof, thereby reducing the air flow path. For this purpose, each of the plurality of cyclone cones 330 has a reverse conical shape, i.e., a shape whose diameter is reduced as approaching the top end thereof.

Referring to FIGS. 4 and 5, each of the plurality of cyclone cones 330 comprises a cone inlet 331, and a cone outer wall 333 forming a cone chamber 332. The cone inlet 331 communicates with the cyclone chamber 322 of the main cyclone chamber 320 through a connection passage 340. The cone chamber 332 makes the dust containing air introduced through the cone inlet 331 swirl, so that fine dust is separated from the air.

As shown in the drawings, the cone outer wall 333 of each of the plurality of cyclone cones 330 has a shape, which is more inclined toward the outer wall 312 of the cyclone body 310 as approaching the top end 333*a* thereof. In other words, the central axes 335 of the swirling streams formed by the plurality of cyclone cones 330 do not coincide with central axis 325 of the swirling stream formed in the main cyclone 320. The fine dust separated from the air in the cone chambers 332 is discharged to the exterior of the plurality of cyclone cones 330. If the plurality of cyclone cones 330 are arranged to be inclined, the dust separated from the air will not re-enter the cone chamber 332. Consequently, the dust can be easily collected and discharged In addition, since relatively large dust is filtered by the main cyclone 320 and relatively fine dust is filtered by the plurality of cyclone cones 330, it is preferable that the bottom of each cyclone chamber 332 is designed to have a large volume. Accordingly, the plurality of cyclone cones 330 are preferably arranged in such a way that the central axes 335 of the swirling streams are more spaced from the central axis 325 of the swirling stream formed by the main cyclone 320 as approaching the top ends of the cone outer walls 333*a*.

Meanwhile, a connection passage 340 is connected to the bottoms of the plurality of cyclone cones 330. The connection passage 340 comprises an inflow path 341, which is inserted into the cyclone chamber 322 so as to discharge the air swirling in the cyclone chamber 322, and plurality of distribution flow paths 342 connected to the inflow path 341 so as to distribute the air into the plurality of cyclone cones 330. The distribution flow paths 342 are arranged to be radially spread around the inflow path 341, wherein the distribution flow paths take a helical shape as they approach the cyclone cone 330. Although the connection passage 340 is integrally formed with the plurality of cyclone cones 330 as shown the drawings, it may be separately provided.

Referring to FIG. 3 again, the top cover 370 is fitted on the top of the cyclone body 310 and formed with an air inflow port 372, through which ambient air is introduced into the cyclone chamber 322. The air inflow port 372 has a spiral structure so that the ambient air can form a swirling stream while it is being introduced into the cyclone chamber 322. In this embodiment, although the air inflow port 372 is shown as being formed in a rectangular cross section, the invention is not limited to this. In other words, the air inflow port may have diverse shapes such as circular, triangular and semi-circular shapes in cross-section.

Meanwhile, the top cover 370 is detachably fitted on the top of the cyclone body 310. Accordingly, when emptying out dust as the cleaning is terminated, it is sufficient for a user only to remove the top cover 370 with one hand so as to empty out the dust collected in the cyclone body 310. Therefore, the work for emptying out the dust from the cleaner can be simply and easily carried out, thereby improving the user's convenience.

Referring to FIG. 3, the discharge cover 390 is fitted on the bottom of the cyclone body 310 and comprises discharge flow paths 391 and an air outflow port 392. One end 391*a* of each discharge flow path 391 is inserted into a corresponding cyclone cone 330, so that the air introduced into the plurality of cyclone cones 330 and the air discharged from the plurality of cyclone cones 330 do not collide with each other. After dust is separated from the air in the plurality of cyclone cones 330, the air is discharged through the discharge flow paths 391. The air outflow port 392 is connected to the other end of each discharge flow path 391. The air discharged through each discharge flow path 391 is collected in the air outflow port 392 and then discharged to the exterior.

Like this, according to the present embodiment, the multi-cyclone dust separating apparatus 300 is constructed in such a way that the air inflow duct 372 is provided through the top cover 370 and air is discharged through the bottom of the cyclone chamber 322, whereby the plurality of cyclone cones 330 can be symmetrically arranged around the main cyclone 320. In other words, a conventional multi-cyclone dust separating apparatus has a problem in that an air inflow port for introducing the air into a main cyclone is formed through a cyclone body, whereby cyclone cones cannot be arranged in a certain area. However, according to the present invention, there is an advantage of improving the dust collection efficiency of a multi-cyclone dust separating apparatus because it is possible to arrange more cyclone cones 330 in a limited size and space without the above-mentioned limitations.

Figure 1:
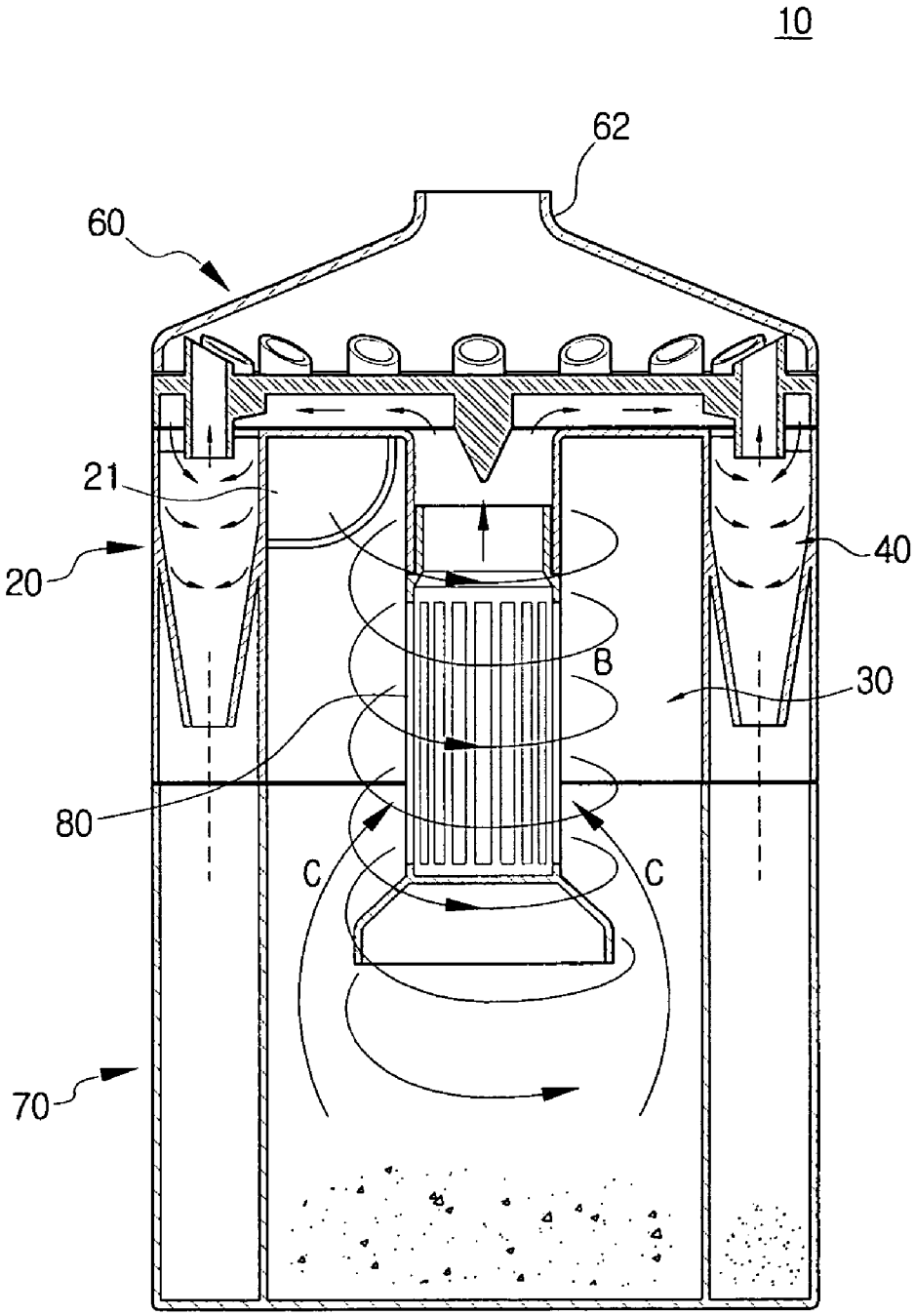
FIG. 1 (PRIOR ART)
FIG. 1 is a sectional view of a conventional multi-cyclone dust separating apparatus.

Meanwhile, because dust is collected within the cyclone body 310, it is not provide a separate dust collection bin 70 as shown in FIG. 1. Accordingly, because the height and volume of the multi-cyclone dust collection device are reduced, there is an advantage of realize a compact multi-cyclone dust separating apparatus 300.

Hereinafter, the operation of the multi-cyclone dust separating apparatus 300 having the above-mentioned structure will be described with reference to FIG. 5.

When a driving source (not shown) of a vacuum cleaner is driven, the dust containing air is introduced through the air inflow port 372 and directed to the cyclone chamber 322. The air introduced into the cyclone chamber 322 flows downwardly while forming a swirling stream. At this time, relatively large dust contained in the air is concentrated toward the inner wall 323 due to the centrifugal force and moves downward due to its weight, thereby being collected on the bottom of the cyclone chamber 322. Whereas, most of the air introduced into the cyclone chamber 322 and separated from the dust reverses direction and flows upward and then escapes the cyclone chamber through the filter part 361 and the body part 362 of the grill member 360.

Then, the air is introduced into the inflow path 341 and then radially spread by the distribution flow paths 342, thereby flowing into the respective cyclone cones 330. The introduced air flows upwardly while forming swirling streams in the cone chambers 332. At this time, the fine dust contained in the air is concentrated toward the cone outer walls 333 and discharged to the exterior of the plurality of cyclone cones 330 by the upwardly flowing air stream. After the dust is removed from the air, the air flows downwardly and discharged through the discharge flow paths 391. The air discharged through each of the discharge flow paths 391 escapes the multi-cyclone dust separating apparatus 300 through the air outflow port 392. Thereafter, the air is discharged to the exterior of the vacuum cleaner via a motor driving chamber (not shown) equipped with a driving source (not shown).

As shown in the drawing, according to the present embodiment, the multi-cyclone dust separating apparatus 300 is arranged in such a way that the air introduced into the top of the main cyclone 320 directly flows out of the bottom of the main cyclone 320 through the grill member 360 and then is introduced into the plurality of cyclone cones 330. In other words, the air flow does not reverse direction in the main cyclone 320 and the air flows downward as indicated by arrow D. Like this, in the multi-cyclone dust separating apparatus 300 according to the embodiment of the invention, because the air flow does not reverse direction in the main cyclone 320, the air flow path can be reduced. Accordingly, there is an effect of reducing the loss in suction force of the driving source (not shown) of the vacuum cleaner. Of course, a part of the air may form a reversed air stream even in the present embodiment. However, because the amount of the air is very little, its effect can be ignored.

Figure 6:
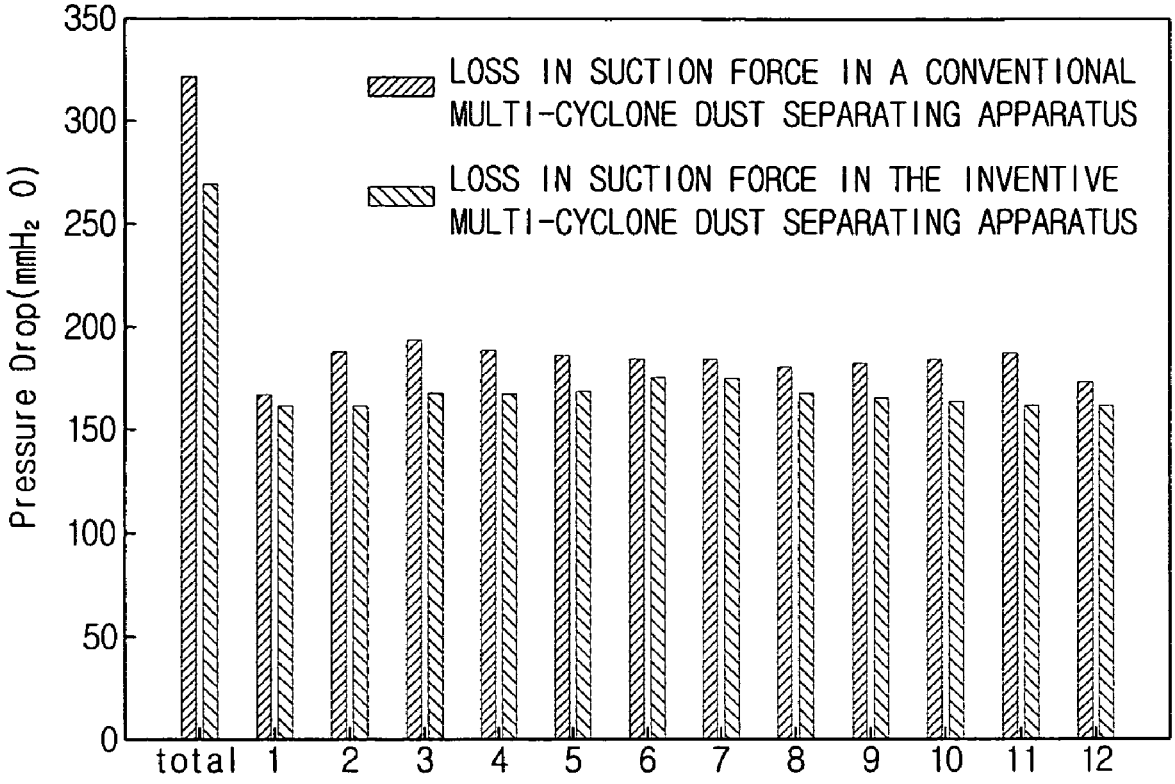
FIG. 6 is a graph showing losses in suction force in comparison between a conventional multi-cyclone dust separating apparatus and a multi-cyclone dust separating apparatus of an embodiment of the invention.

FIG. 6 is a graph showing losses in suction force caused in a conventional multi-cyclone dust separating apparatus 10 as shown in FIG. 1 and the inventive multi-cyclone dust separating apparatus 300, wherein the losses in suction force were measured through repeated experiments.

In the graph, the first pair of values (total) on the abscissa indicate losses in suction force caused in the whole apparatus for the conventional multi-cyclone dust separating apparatus and the inventive multi-cyclone dust separating apparatus, respectively and the other pairs of values (between 1 and 12) indicate losses in suction force caused in each cyclone cone, for the conventional multi-cyclone dust separating apparatus and the inventive multi-cyclone dust separating apparatus, respectively. As shown in the graph, the loss in suction force (pressure drop) produced in the whole apparatus for the conventional multi-cyclone dust separating apparatus 10 is about 325 $mmH_2O$ and the loss in suction force (pressure drop) produced in the whole apparatus for the inventive multi-cyclone dust separating apparatus 300 is about 270 $mmH_2O$. Accordingly, it can be seen that the loss in suction force is reduced about 17% in the inventive multi-cyclone dust separating apparatus 300 as compared to the conventional multi-cyclone dust separating apparatus. As can be seen from the graph, the loss in suction force for each cyclone cone is also reduced in the inventive multi-cyclone dust separating apparatus as compared to the conventional one.

As described above, the multi-cyclone dust separating apparatus according to the invention has following effects:

i) Ambient air is introduced into the top of the main cyclone and discharged through the bottom thereof, and the air introduced into the main cyclone escapes the main cyclone without being reversed so as to flow into the plurality of cyclone cones, whereby the loss in suction force of the driving source can be reduced.

ii) Because dust is collected within the cyclone body, the multi-cyclone dust separating apparatus can be compact in construction.

iii) Because air is introduced into the top of the main cyclone and discharged through the bottom thereof, there is no limitation in arranging the plurality of cyclone cones. In other words, because more cyclone cones can be provided compared to a conventional multi-cyclone dust separating apparatus, and the plurality of cyclone cones can be symmetrically arranged, the dust collection efficiency can be improved.

iv) If the plurality of cyclone cones are arranged to be inclined, it is possible to easily collect and empty out dust from the multi-cyclone dust separating apparatus.

v) Because it is sufficient to only remove the top cover so as to empty out the collected dust, user's convenience can be enhanced.

Although representative embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A multi-cyclone dust separating apparatus comprising:

a cyclone body including a main cyclone, and a plurality of cyclone cones communicating with the main cyclone and arranged around a lower part of the main cyclone, each of the plurality of cyclone cones being formed in a reverse conical shape having a diameter that is reduced as approaching a top end thereof;

a top cover fitted on a top of the cyclone body and having an air inflow port for introducing ambient air into the main cyclone; and a discharge cover fitted on a bottom of the main cyclone so as to collect and discharge the air discharged from the plurality of cyclone cones, wherein most of the air introduced into the top of the main cyclone through the air inflow port is discharged to the bottom of the main cyclone without direction to ascend, thereby being introduced into the plurality of cyclone cones through a bottom end thereof.

2. The multi-cyclone dust separating apparatus of claim 1, wherein the plurality of cyclone cones are arranged to be symmetrical about an inner wall of the main cyclone.

3. The multi-cyclone dust separating apparatus of claim 2, wherein the main cyclone produces a swirling stream of air having a first central axis and the plurality of cyclone cones produce a swirling stream of air having a second central axis, wherein the first and second central axes are not parallel to each other.

4. The multi-cyclone dust separating apparatus of claim 3, wherein each of the plurality of cyclone cones is configured in such a way that the second central axis is more spaced from the first central axis as approaching a top end thereof.

5. The multi-cyclone dust separating apparatus of claim 4, wherein the top cover is detachably fitted to the cyclone body.

6. The multi-cyclone dust separating apparatus of claim 1, wherein the dust is collected in the cyclone body after being separated from the air in the main cyclone and the plurality of cyclone cones.

7. A multi-cyclone dust separating apparatus comprising:

a cyclone body including a main cyclone, and a plurality of cyclone cones arranged around a lower part of the main cyclone, each of the plurality of cyclone cones having a reverse conical shape with a diameter that is reduced as approaching a top end of the plurality of cyclone cones, the plurality of cyclone cones being arranged in the cyclone body so that air is introduced into a bottom end of the plurality of cyclone cones; and a top cover fitted on a top of the cyclone body and having an air inflow port of a spiral structure, wherein air introduced through the air inflow port separates from dust by swirling in the main cyclone and is introduced into the plurality of cyclone cones to secondarily filter fine dust contained in the air.

8. The multi-cyclone dust separating apparatus of claim 7, wherein each of the plurality of cyclone cones is configured in such a way that a swirling stream of air having a first central axis is produced and the main cyclone is configured in such a way that a swirling stream of air having a second central axis is produces, the second central axis being more spaced from the first central axis as approaching a top end thereof.

* * * * *